US007736828B2

(12) United States Patent
Regev et al.

(10) Patent No.: US 7,736,828 B2
(45) Date of Patent: Jun. 15, 2010

(54) LIQUID TONER METHODS OF PRODUCING SAME

(75) Inventors: Keren Regev, Tel Aviv (IL); Albert Teishev, Rishon le-zion (IL); Shahar Stein, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1391 days.

(21) Appl. No.: 11/068,620

(22) Filed: Feb. 28, 2005

(65) Prior Publication Data

US 2006/0194138 A1 Aug. 31, 2006

(51) Int. Cl.
*G03G 9/12* (2006.01)

(52) U.S. Cl. ..... 430/115; 430/137.19; 430/137.22

(58) Field of Classification Search ..... 430/114, 430/115, 137.22, 137.19
See application file for complete search history.

(56) References Cited

U.S. PATENT DOCUMENTS 3,259,581 A * 7/1966 Matkan ..... 430/115
3,997,460 A * 12/1976 Sirine et al. ..... 510/191
4,221,856 A * 9/1980 Lu ..... 430/108.2
4,756,986 A * 7/1988 Gibson ..... 430/114
4,820,605 A * 4/1989 El-Sayed ..... 430/115
5,117,263 A * 5/1992 Adam et al. ..... 399/233
5,482,812 A * 1/1996 Hopper et al. ..... 430/137.14
5,554,476 A * 9/1996 Landa et al. ..... 430/110.1
5,672,456 A * 9/1997 Chamberlain et al. ..... 430/115
5,923,929 A * 7/1999 Avraham et al. ..... 399/237
5,994,020 A * 11/1999 Patel et al. ..... 430/137.14
6,335,136 B1 * 1/2002 Pan et al. ..... 430/115
6,413,318 B2 * 7/2002 Yoo et al. ..... 118/620

* cited by examiner

*Primary Examiner*—Janis L Dote
(74) *Attorney, Agent, or Firm*—Hewlett-Packard Development Company, L.P.

(57) ABSTRACT

A liquid toner comprising a hydrocarbon carrier liquid; toner particles; wax particles; and a charge director. Methods of producing embodiments of the toner and components of the toner are disclosed.

33 Claims, 3 Drawing Sheets

LIQUID TONER METHODS OF PRODUCING SAME

FIELD OF THE INVENTION

The present invention is concerned with a liquid toner useful for the production of images.

BACKGROUND OF THE INVENTION

Liquid toners comprised of (optionally) colored charged polymer toner particles dispersed in a carrier liquid, are well known.

Liquid toners generally have additional ingredients which improve one or more characteristics of the toners. These include "charge directors" which attach to the toner particles and cause them to be charged, "charge adjuvants" which improve the chargeability of the toner particles by the charge director, etc.

Liquid toner with added silica particles is well known in the art. The object of these particles is to improve the durability of the toner particles after they are fused and fixed to a final substrate.

U.S. Pat. No. 5,923,929, the disclosure of which is incorporated by reference, describes a liquid toner in which the toner particles are comprised of both a polymer and a wax.

U.S. Pat. No. 4,526,852, the disclosure of which is incorporated by reference, describes a liquid toner in which wax particles are provided in the carrier liquid. The toner particles do not appear to be polymer particles, since the polymer is dissolved in the carrier liquid.

It should be understood that the above referenced patents and other publications are exemplary and the use of at least some of these substances is described in other publications as well. All of the above referenced patents and publications are incorporated herein by reference.

SUMMARY OF THE INVENTION

The present application deals, generally, with new toners (and methods of preparation) that result in more durable images.

An aspect of some embodiments of the invention is the provision of wax particles in a liquid toner based on, optionally pigmented, polymer based toner particles.

An aspect of some embodiments of the invention is concerned with the preparation of a wax additive for liquid toners in which the wax is ground separately from the toner particles and added to the toner after the toner particles are prepared. In an exemplary embodiment of the invention, the wax is ground with ISOPAR L.

In an embodiment of the invention, the wax is ground with a charge adjuvant, for example, by grinding the wax particles in a hydrocarbon liquid with the charge adjuvant, to increase the chargeability of the wax particles by a charge director used to charge the toner particles.

In some embodiments of the invention, the toner comprises, optionally pigment, polymer particles and the toner particles also comprise activated silica, for example silica having a Methacryl propyl trimethoxy silane functionality.

An aspect of some embodiments of the invention is concerned with a liquid toner containing toner particles comprising activated silica therein. In an exemplary embodiment of the invention, these toner particles contain silica having a Methacryl propyl trimethoxy silane functionality.

In general, print quality is measured using a number of different tests, each of which tests a different characteristic of the toner. In the present application, three testing methods are considered.

There is thus provided, in accordance with an embodiment of the invention, liquid toner comprising:

a hydrocarbon carrier liquid;

toner particles comprising an, optionally pigmented, polymer;

wax particles; and a charge director.

Optionally, the wax particles are treated with a charge adjuvant to increase their susceptibility to charging, such that the charge director is effective to charge the toner particles and the wax particles. Optionally, the wax particles are treated by adhering the charge adjuvant to them. Optionally, the charge adjuvant comprises aluminum-tri-stearate.

In an embodiment of the invention, the wax particles comprise a polyethylene wax.

In an embodiment of the invention, the toner particles comprise a pigment and silica dispersed in a polymer. Optionally, the silica is present in a weight percentage NVS (non-volatile solids) of between 1 and 5 percent, preferably between 2 and 4 percent. Optionally, the silica is activated silica. Optionally, the silica has a Methacryl propyl trimethoxy silane functionality.

In an embodiment of the invention, the treated wax particles are present in a weight percentage NVS of between 3 and 7, preferably between 4 and 6 percent with respect to the toner particles.

There is further provided, in accordance with an embodiment of the invention, a method of producing liquid toner, comprising:

producing a dispersion of toner particles comprising a polymer, in hydrocarbon carrier liquid;

adding wax particles to the dispersion of toner particles in carrier liquid; and adding a charge director to the dispersion.

In an embodiment of the invention, the method includes: treating the wax particles with a charge adjuvant to increase their susceptibility to charging by the charge director, such that both the toner and wax particles are charged. Optionally, the wax particles are treated prior to adding them to the dispersion of toner particles. Optionally, the treatment comprises attachment of the charge adjuvant to the wax particles. Optionally, treating the wax particles comprises grinding the wax particles together with the charge adjuvant. Optionally, the charge adjuvant comprises aluminum tri-stearate.

In an embodiment of the invention, treating the wax particles comprises grinding the wax particles in a hydrocarbon carrier liquid.

In an embodiment of the invention, the toner particles comprises producing toner particles comprising a pigment and silica dispersed in the polymer. Optionally, the silica is present in a weight percentage NVS of between 1 and 5 percent, preferably, between 2 and 4 percent. Optionally, is activated silica, preferably, having a Methacryl propyl trimethoxy silane functionality.

Optionally, the treated wax particles are present in a weight percentage NVS of between 3 and 7 percent, preferably, between 4 and 6 percent with respect to the toner particles.

In an embodiment of the invention, the wax comprises a polyethylene wax.

In further embodiments of the invention a printed sheet comprising a multicolored liquid toner image produced using a liquid toner according to the invention or at least one pigmented liquid toner according to the invention is provided.

There is further provided, in accordance with an embodiment of the invention, a method of producing wax particles suitable for use as an additive to a liquid toner, the method comprising:

providing wax particles; and treating the wax particles to make them more susceptible to charging with a charge director.

In an embodiment of the invention, treating comprises grinding the wax particles together with a carrier liquid. Optionally, the wax particles are ground together with a charge adjuvant. Optionally, the charge adjuvant is aluminum tri-stearate. Optionally, the wax comprises a polyethylene wax.

BRIEF DESCRIPTION OF THE FIGURES

Exemplary non-limiting embodiments of the invention will be described with reference to the following description of the embodiments, in conjunction with the figures, in which.

DETAILED DESCRIPTION OF EXEMPLARY EMBODIMENTS

Figure 1:
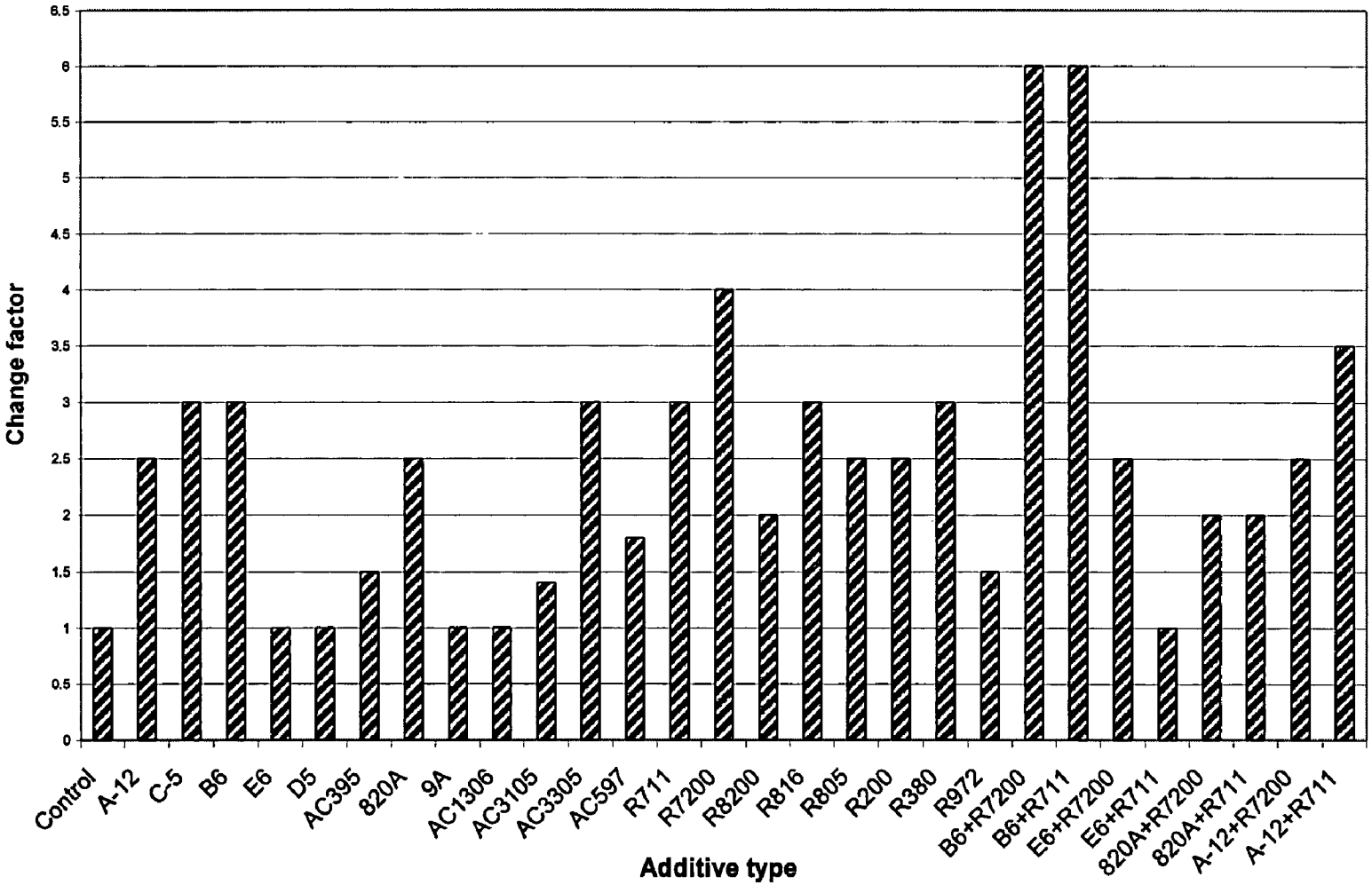
FIG. 1 is a graph of results of a flake test for printed areas produce with various toners have none, one both of silica and wax.

As indicated above, the present invention is generally concerned with liquid toners which, when printed, produce images having improved durability.

In general, print quality and durability are measured using a number of different tests, each of which tests a different characteristic of the toner. In the present discussion, three testing methods, which are related to durability of the toner, are considered.

The first of these is a test for flaking. This test measures adhesion of two layers of toner to each other a short time after printing while the image is somewhat wet. An exemplary flaking test is performed by printing a page with two layers of contrasting ink one on top of the other. A first sheet printed with two layers is covered with a similarly printed second sheet of the same substrate type. A weight is covered by the second sheet and the weight and second sheet, with the second sheet facing the first, is slid with a circular motion for a short time, on the first sheet. This test is performed on freshly printed substrates. The amount of the outer layer of ink on the first sheet that is removed (generally flaking off, hence the name of the test) by this process is found to correlate with problems that may arise in damage to an image during cutting of the image, for example, using a guillotine in a finisher or the like, which acts on sheets that are freshly printed.

A second test is for peeling. This tests the adhesion of a layer of toner to a substrate on which it is printed. An exemplary peeling test is performed by pressing a piece of masking tape against a surface of a substrate printed with a single layer of toner. The tape is peeled from the sheet and the % of the damaged area is measured by scanning the tested print and comparing it to a non-damaged area. This measurement is made on printed surfaces, which have been allowed to set for 10 minutes. This test is associated with the adhesion of the printed film to the substrate. A poor adhesion reflected a high peeling result may also reflect transfer difficulties that in the long run may cause damages to an intermediate transfer blanket.

A third test is a rub test. This test is associated with abrasion resistance of the printed image. Commercial equipment, such as a SUTHERLAND Rub Tester (Danilee Co., San Antonio, Tex.) can be used to abrade the image in a controlled manner. The rub resistance is measured, for example, by comparing the image density or otherwise defined as color strength which is correlated with color optical density before and after the test.

These tests must be performed under controlled conditions so that results can be compared. Due to variability in the printing results caused by environmental conditions and the like, when comparing different toners, results are advantageously performed on the test specimens together with control specimens produced at the same time and under the same conditions as the test specimen. This allows for comparison of the results of the test specimen with a suitable control.

A series of liquid toners were prepared and tested. In general, these toners can be divided into four categories.

The first category is a basic toner which has neither silica added to the toner particles and which does not contain any wax.

The second category is a toner in which the toner particles contain silica, but the toner does not contain any wax.

The third category is a toner in which the toner contains a wax, but in which the toner particles do not contain any silica. Several variations on the method of adding wax to the toner are described.

The fourth category is a toner which contains both separate wax particles and silica in the toner particles.

All of the toners tested were based on toner particles produced by the same basic process, with only a change in some of the ingredients. In general, the following is the methodology for manufacturing the toners used in these tests. It is noted that many methods exist in the literature for manufacturing liquid toner, any of which should be suitable for use with the invention.

Production of Toner Particles

As a first step, 750 grams of polyethylene-acrylic acid co-polymer (NUCREL 699, E. I. Du Pont de Nemours and Company, Wilmington, Del. is mixed in a ROSS double planetary mixer (Charles Ross & Son Co., Hauppauge, N.Y.) with 1750 grams of ISOPAR L (an iso-parfinic oil manufactured by Exxon Mobile Corp. in Irving, Texas) carrier liquid at a speed of 60 rpm and a temperature of 130° C. for one hour. The temperature is then reduced and mixing is continued until the mixture reaches room temperature. During mixing the polymer solvates the ISOPAR and during the cooling granules of polymer (with solvated carrier liquid) in carrier liquid are produced As a second step, 1500 grams of the mixture produced in the first step is charged into a Union Process Co. (Akron, Ohio) 1S ATTRITOR ball grinder together with 10 grams of aluminum tri-stearate Riedel-De Haen Gmbh, Seelze, Germany) as a charge adjuvant and 65 grams of pigment blue 15:3 pigment (Toyo Ink Mfg. Co., Ltd., Tokyo, Japan), and 700 more grams of ISOPAR L. Where silica is indicated, 10 grams of the indicated silica are added. The mixture is ground for 2 hours at 55° C. followed by grinding for 10 hours at 40° C. until a toner concentrate having toner particles incorporating the adjuvant and pigments is produced.

Where no silica is used, the percentage of polymer is about 85% (80%-90%), the percentage of aluminum tri-stearate is about 2%, (1%-3%) and the percentage of pigment is about 13% (10%-20%) all by weight of the NVS. Where silica is used the percentage of silica is about 3% (1%-5%), the percentage of polymer is about 82% (75%-90%), the percentage of aluminum tri-stearate is about 2% (1%-3%) and the percentage of pigment is about 13% (10-20%) and the percentage of charge director is about all by weight of the NVS.

In practice, toner compositions can vary depending on the characteristics, color, etc. desired, so that in some situations the percentages can vary within (or even outside) the ranges given in parentheses after each percentage component. In addition, the type of polymer used and other components can vary, as known in the art.

Preparation of Wax Additive

96% (94%-98%) wax 670 grams 4% (2%-6%) 30 grams of aluminum tri-stearate are charged into a 1S ATTRITOR. The mixture was ground together with 1600 grams of ISOPAR L for 12 hours at a temperature of 25° C. However, it is observed that good results are also achieved for higher temperatures, such as 40° C. Alternatively, a hot grinding at 58° C. followed by a cold grinding also provides good results. The result are round shaped particles, in median size of 3 microns as measured by using a COULTER particle size analyzer (Beckman Coulter, Inc., Fullerton, Calif.).

Preparation of the Toner

This toner concentrate is charged utilizing 1.5 mg/g of charge director (NVS toner particles at 25% NVS) of a charge director and diluted with additional ISOPAR L and MARCOL 82 (Exxon Mobile Corp.) to produce a toner having a 2% NVS, with 98% of the carrier liquid being ISOPAR L and 1% MARCOL 82. A commercially available charge director of proprietary composition (INDIGO Imaging Agent 4.0, Hewlett-Packard Co., Palo Alto, Calif.) was used in the experiments. Other charge directors as known in the art can also be used. Where a wax is indicated as being added, wax particles suspended in ISOPAR L in a weight percentage of 5% % (3%-7%) with respect to the NVS of the toner particles is added.

The result is a cyan toner. All of the experiments reported below were with cyan toner, although the inventive concepts can be applied to other color or uncolored toners as well. Cyan was chosen for this experimentation and comparison, since cyan has higher sensitivity to fixing changes than other colors and since the fixing properties of the cyan are poor compared to other colors, providing "worst case" results.

It is noted that the toners used in some of the experiments were produced by adding the wax and toner to the toner material at the start of the grinding. While this method produced a toner with the same durability characteristics as given below, it was found that its effect on the intermediate transfer blanket was problematic (see below). However, the durability properties were not affected, so that the comparison shown below is valid.

Materials Used

Other than the materials specifically named above, the following materials were used.

The types of waxes used in the experiments, as indicated in the graphs (codes used on graphs are the manufacturer's designation), are shown in Table I:

TABLE I

| Grade | Basic formulation | Mettler drop point | Hardness Dmm | Density g/cc | Physical form | Viscosity cps @140° C. | Acid no. mg KOH/g |
|---|---|---|---|---|---|---|---|
| A-C 9A | P.E homo-polymer | 115° C. | 0.5 | 0.93 | powder | 450 | Nil |
| A-C 820 A | P.E homo-polymer | 126 | <0.5 | 0.96 | powder | 80 | Nil |
| A-C 395 | P.E H.D oxidized H.P | 137 | <0.5 | 1 | Granule | 2500 @ 150° C. | 41 |
| AC 597 | P.P maleic anhydride copolymer | 143 | <0.5 | 0.94 | Pastilles/ powder | 500 @ 190° C. | 80 |
| ACUMIST A-12 | Micronized P.E wax | 137 | <0.5 | 0.99 | Micronized powder | P.S 12 um | 26-40 |
| ACUMIST B-6 | Micronized P.E wax | 126 | <0.5 | 0.96 | Micronized powder | P.S 6 um | Nil |
| ACUMIST C-5 | Micronized P.E wax | 121 | 1 | 0.95 | Micronized powder | P.S 5 um | Nil |
| ACUMIST D-5 | Micronized P.E wax | 118 | 1.5 | 0.95 | Micronized powder | P.S 5 um | Nil |
| ACUMIST E-6 | Micronized P.E wax | 113 | 1 | 0.94 | Micronized powder | P.S 6 um | Nil |
| ACUMIST 3105 | PTFE (TEFLON) Micronized wax blend | 121 | 1.0 | 0.98 | Micronized powder | P.S 5 um | Nil |
| ACUMIST 3305 | PTFE (TEFLON) Micronized wax blend | 121 | <0.5 | 1.1 | Micronized powder | P.S 5 um | Nil |
| ACUMIST 1306 | FT micronized wax | 114 | <0.5 | 0.94 | Micronized powder | P.S 4 um | Nil |

The types of silica used in the experiments, as indicated in the graphs (codes used on graphs are the manufacturer's designation), are shown in Table II:

All the types of silica used are produced by Degussa Gmbh LLC, Hanau, Germany. Note that the R 711 and R 7200 materials are similar in chemical structure and have relatively active functional groups. They are designated herein as active silica.

TABLE II

| Grade | Function | Avg. size (nm) | Surface area ($m^2$/gr) | Bulk density (g/L) | pH in 4% dispersion |
|---|---|---|---|---|---|
| AEROSIL 200 | —OH | 12 | 200 ± 25 | 30 | 3.7-4.7 |
| AEROSIL 380 | —OH | 7 | 380 ± 30 | 50 | 3.7-4.7 |
| AEROSIL R 711 | Methacryl propyl trimethoxy silane | 12 | 150 ± 25 | 50 | 4.0-6.0 |
| AEROSIL R 7200 | Methacryl propyl trimethoxy silane | 12 | 150 ± 25 | 250 | 4.0-6.0 |
| AEROSIL R 8200 | $(CH_3)_3$ | | 160 ± 25 | 140 | ≧5 |
| AEROSIL R 805 | $C_8H_{17}$ | | | | |
| AEROSIL R 816 | $C_{16}H_{33}$ | | 190 ± 20 | 40 | 4.0-5.5 |
| AEROSIL R 972 | $(CH_3)_2$ | 16 | 110 ± 20 | 50 | 3.7-5.5 |

Figure 2:
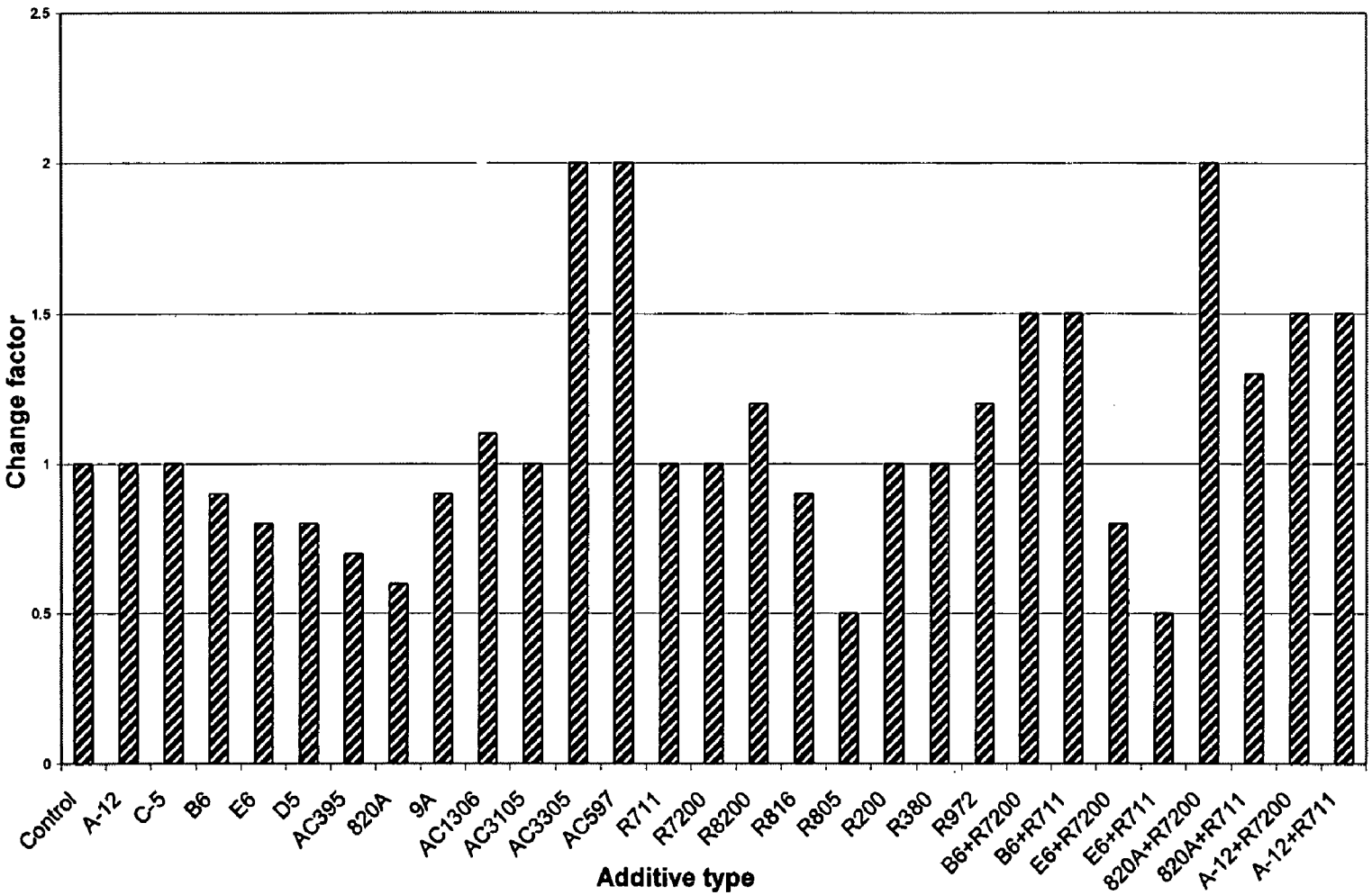
FIG. 2 is a graph of results of a peel test for printed areas produce with various toners have none, one both of silica and wax.
Figure 3:
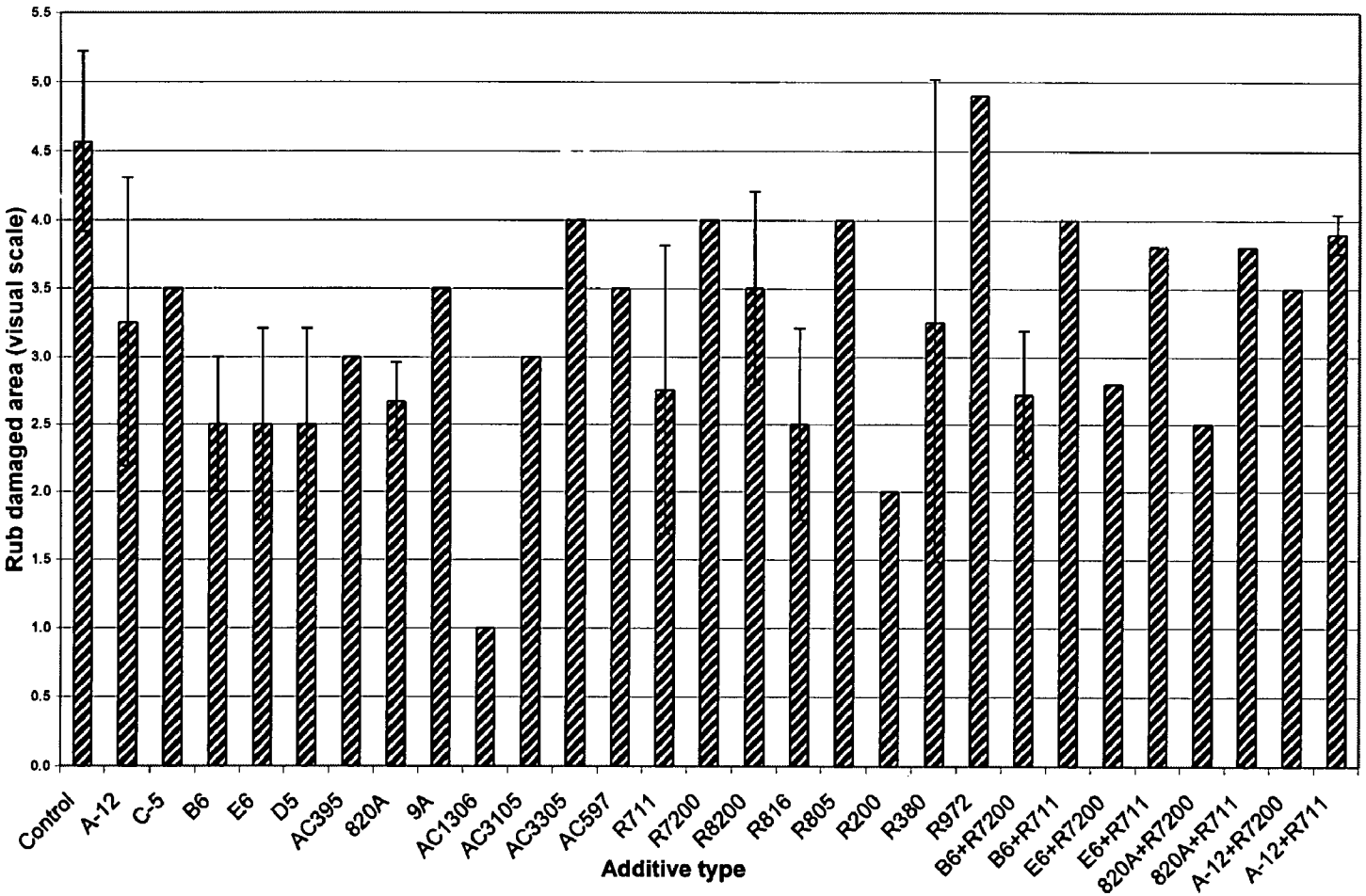
FIG. 3 is a graph of results of an abrasion test for printed areas produce with various toners have none, one both of silica and wax.

FIGS. 1-3 show results of durability testing for various types of toners with varying compositions. The toner without either silica or wax is designated as "control" on the graphs and is the leftmost bar on each of the graphs. The toners with added wax particles, but with no silica are the next 12 bars. The toners with silica in the toner particles are the next 8 bars and toners with silica in the toner particles and added wax particles are represented by the 8 rightmost bars.

Printing was carried out on an H-INDIGO Press Series 3000 (Hewlett-Packard Co., Palo Alto, Calif.), which utilizes a developer system such as that shown in U.S. Pat. No. 5,596,396 to Landa et al, and U.S. Pat. No. 5,610,694, to Lior et al, the disclosures of which is incorporated by reference. This press utilizes a heated intermediate transfer member having a blanket with a coating of a condensation type release layer as described in WO 96/11426, the disclosure of which is incorporated by reference.

Results are shown for printing on acrylic coated substrates. These substrates were chosen since they are common and since adhesion to acrylic substrates is very poor. For other substrates tested the results are similar, but not identical and usually better.

FIG. 1 is a graph of results of a flaking test for printed areas produced with various toners having none, one or both of silica and wax. This is a graph of improvement of the flaking results as compared with the reference (higher numbers are better). It is seen that most of the toners containing wax, silica or both are better than those for the control, with especially good results for the activated silica and the B6 wax. In practice, this improvement is very important.

FIG. 2 is a graph of results of a peel test for printed areas produced with various toners having none, one both of silica and wax. This is a graph of improvement of the peeling results as compared with the reference (higher numbers are better). It is seen that many of the toners containing wax, silica or both are better than those for the control, with good results for the activated silica and the B6 wax. In practice, this improvement is less important than the improvement for flaking.

FIG. 3 is a graph of results of an abrasion test for printed areas produced with various toners having none, one both of silica and wax. This is a graph of values of abrasion results (in damaged area, such that lower numbers are better. It is seen that all but one of the toners containing wax, silica or both are better than those for the control, with good results for the activated silica and the B6 wax. In practice, this improvement reflects the durability of the image to scratches and mechanical damages caused by finishing equipment.

A number of less successful experiments should be noted. Grinding the wax without the charge adjuvant resulted in poor transfer of the wax particles to the image. Addition of the wax to the toner, without grinding as powder, caused damage to the developer system and especially to the developer roller, resulting in poor images. Addition of the wax during grinding of the toner particles cause severe damage to the intermediate transfer blanket. Neither of the last two effects is completely understood.

It should be understood that the toner may be used to produce multi-colored images by using one or more liquid toners using, for example, the above referenced HP Indigo Press or other liquid toner equipment.

The invention has been described in the context of the best mode known to the inventors for carrying it out. It should be understood that not all features shown or described in an actual toner, in accordance with some embodiments of the invention. Furthermore, variations on the method and toner disclosed are included within the scope of the invention, which is limited only by the claims. The words "comprise", "include" and their conjugates as used herein mean "include but are not necessarily limited to."

The invention claimed is:

1. A liquid toner comprising:

a hydrocarbon carrier liquid;

toner particles comprising an, optionally pigmented, polymer and activated silica having a Methacryl propyl trimethoxy silane functionality;

wax particles; and a charge director.

2. A liquid toner according to claim 1 wherein the wax particles are treated with a charge adjuvant to increase their susceptibility to charging, such that the charge director is effective to charge the toner particles and the wax particles.

3. A liquid toner according to claim 2, wherein the wax particles are treated by adhering the charge adjuvant to them.

4. A liquid toner according to claim 3 wherein the charge adjuvant comprises aluminum-tri-stearate.

5. A liquid toner according to claim 2 wherein the wax particles comprise a polyethylene wax.

6. A liquid toner according to claim 1 wherein the toner particles comprise a pigment, the pigment and silica being dispersed in the polymer.

7. A liquid toner according to claim 6 wherein a weight percentage NVS of the silica in the toner particles is between 1 and 5 percent.

8. A liquid toner according to claim 7 wherein a weight percentage NVS of the silica in the toner particles is between 2 and 4 percent.

9. A liquid toner according to claim 1 wherein the wax particles are present in a weight percentage NVS of between 3 and 7 percent with respect to the toner particles.

10. A liquid toner according to claim 9 wherein the wax particles are present in a weight percentage NVS of between 4 and 6 percent with respect to the toner particles.

11. A method of producing liquid toner, comprising:

producing a dispersion of toner particles comprising a polymer and activated silica having a Methacryl propyl trimethoxy silane functionality, in hydrocarbon carrier liquid;

adding wax particles to the dispersion of toner particles in carrier liquid; and adding a charge director to the dispersion.

12. A method according to claim 11 and including treating the wax particles with a charge adjuvant to increase their susceptibility to charging by the charge director, such that both the toner and wax particles are charged.

13. A method according to claim 12 wherein the wax particles are treated prior to adding them to the dispersion of toner particles.

14. A method according to claim 13 wherein the treatment comprises attachment of the charge adjuvant to the wax particles.

15. A method according to claim 14 wherein treating the wax particles comprises grinding the wax particles together with the charge adjuvant.

16. A method according to claim 15 wherein the charge adjuvant comprises aluminum tri-stearate.

17. A method according to claim 13 wherein treating the wax particles comprises grinding the wax particles in a hydrocarbon carrier liquid.

18. A method according to claim 11 wherein producing the toner particles comprises producing toner particles comprising a pigment and the silica dispersed in the polymer.

19. A method according to claim 18 wherein a weight percentage NVS of the silica in the toner particles is between 1 and 5 percent.

20. A method according to claim 19 wherein a weight percentage NVS of the silica in the toner particles is between 2 and 4 percent.

21. A method according to claim 12 wherein the treated wax particles are present in a weight percentage NVS of between 3 and 7 percent with respect to the toner particles.

22. A method according to claim 21 wherein the treated wax particles are present in a weight percentage NVS of between 4 and 6 percent with respect to the toner particles.

23. A method according to claim 11 wherein the wax comprises a polyethylene wax.

24. A printed sheet comprising a multicolored liquid toner image produced using at least one pigmented liquid toner according to claim 1.

25. A printed sheet comprising a multicolored liquid toner image produced using at least one pigmented liquid toner produced according to the method of claim 18.

26. A method of producing liquid toner, comprising:

producing a dispersion of toner particles comprising a polymer, in hydrocarbon carrier liquid;

providing wax particles;

treating the wax particles by grinding them together with a charge adjuvant and attaching the charge adjuvant to them to make them more susceptible to charging with a charge director; and after treating the wax particles, adding them to the dispersion of toner particles in carrier liquid, such that both the toner and wax particles may be charged.

27. A method according to claim 26 wherein the charge adjuvant is aluminum tri-stearate.

28. A method according to claim 26 wherein the wax comprises a polyethylene wax.

29. A method according to claim 26 wherein the toner particles comprise a pigment and silica dispersed in the polymer.

30. A method according to claim 29 wherein the silica comprises activated silica having a Methacryl propyl trimethoxy silane functionality.

31. A method according to claim 30 wherein a weight percentage NVS of the silica in the toner particles is between 2 and 4 percent.

32. A method according to claim 26 wherein the treated wax particles are present in a weight percentage NVS of between 3 and 7 percent with respect to the toner particles.

33. A method according to claim 26 further comprising adding the charge director to the dispersion of toner particles in carrier liquid.

* * * * *

UNITED STATES PATENT AND TRADEMARK OFFICE

CERTIFICATE OF CORRECTION

PATENT NO. : 7,736,828 B2
APPLICATION NO. : 11/068620
DATED : June 15, 2010
INVENTOR(S) : Keren Regev et al.

It is certified that error appears in the above-identified patent and that said Letters Patent is hereby corrected as shown below:

In column 6, line 61, below "TABLE I" insert -- All the types of waxes used are produced by Honeywell International Inc., Morristown, New Jersey. --.

In column 7, line 31, delete "H-INDIGO" and insert -- INDIGO --, therefor.

Signed and Sealed this
Twenty-sixth Day of April, 2011

David J. Kappos

David J. Kappos
*Director of the United States Patent and Trademark Office*